US009515406B2

(12) United States Patent
Yu et al.

(10) Patent No.: US 9,515,406 B2
(45) Date of Patent: Dec. 6, 2016

(54) ELECTRICAL CONNECTOR WITH IMPROVED ELECTRICAL CONTACTS

(71) Applicant: ALLTOP ELECTRONICS (SUZHOU) LTD., Taicang, JiangSu Province (CN)

(72) Inventors: Wang-I Yu, Jhonghe (TW); Yung-Chih Hung, Jhonghe (TW); Ya-Juan Gou, Jhonghe (TW); Zhi-Qiang Rong, Jhonghe (TW)

(73) Assignee: ALLTOP ELECTRONICS (SUZHOU) LTD., Taicang, Jiangsu Province (CN)

( * ) Notice: Subject to any disclaimer, the term of this patent is extended or adjusted under 35 U.S.C. 154(b) by 0 days.

(21) Appl. No.: 14/708,861

(22) Filed: May 11, 2015

(65) Prior Publication Data

US 2016/0064848 A1 Mar. 3, 2016

(30) Foreign Application Priority Data

Sep. 1, 2014 (CN) ..... 2014 1 0439460

(51) Int. Cl.

| | |
|---|---|
| ***H01R 13/10*** | (2006.01) |
| ***H01R 13/41*** | (2006.01) |
| *H01R 13/50* | (2006.01) |
| *H01R 12/57* | (2011.01) |
| *H01R 13/11* | (2006.01) |

(52) U.S. Cl.

CPC ..... *H01R 13/41* (2013.01); *H01R 12/57* (2013.01); *H01R 13/112* (2013.01); *H01R 13/50* (2013.01)

(58) Field of Classification Search

CPC ..... H01R 13/42; H01R 13/50; H01R 13/7039; H01R 13/7033; H01R 13/6473; H01R 13/658; H01R 13/4367; H01R 13/422; H01R 12/57

USPC ..... 439/682

See application file for complete search history.

(56) References Cited

U.S. PATENT DOCUMENTS

| | | | | | |
|---|---|---|---|---|---|
| 3,697,925 | A * | 10/1972 | Henschen | H01R 12/69 | 439/422 |
| 3,711,819 | A * | 1/1973 | Matthews | H01R 13/11 | 439/682 |
| 4,571,017 | A * | 2/1986 | Fujita | H01R 13/4223 | 439/282 |
| 4,714,306 | A * | 12/1987 | Miyazawa | H01R 43/01 | 439/395 |
| 4,863,400 | A * | 9/1989 | Sato | H01R 13/422 | 439/400 |
| 4,971,580 | A * | 11/1990 | Ward | H01R 13/4367 | 264/272.13 |

(Continued)

*Primary Examiner* — Jean F Duverne

(74) *Attorney, Agent, or Firm* — Sughrue Mion, PLLC

(57) ABSTRACT

An electrical connector includes an insulative housing and a number of electrical contacts. The insulative housing has a top wall, a bottom wall and a number of side walls. The side walls form a number of passageways extending through the insulative housing. The electrical contacts are received in the passageways and each includes a contacting portion, a tail portion and a main portion connecting with the contacting portion and the tail portion. The main portion is provided with a first fastening means for engaging with the side wall and a second fastening means for engaging with the top wall so as to secure the electrical contacts to the insulative housing.

20 Claims, 7 Drawing Sheets

(56) References Cited

U.S. PATENT DOCUMENTS

| | | | | |
|---|---|---|---|---|
| 8,690,608 | B2 * | 4/2014 | Naito | H01R 13/7039<br>439/607.01 |
| 8,721,376 | B1 * | 5/2014 | Bishop | H01R 12/57<br>439/441 |
| 8,926,367 | B2 * | 1/2015 | Hsu | H01R 13/658<br>439/607.35 |
| 9,065,219 | B2 * | 6/2015 | Naito | H01R 13/7033 |
| 9,225,135 | B2 * | 12/2015 | Kondo | H01R 13/6473 |

* cited by examiner

ELECTRICAL CONNECTOR WITH IMPROVED ELECTRICAL CONTACTS

BACKGROUND OF THE INVENTION

1. Field of the Invention

The present invention relates to an electrical connector, and more particularly to an electrical connector having improved electrical contacts.

2. Description of Related Art

With the development of electronics, electrical connectors are widely used to electrical devices for connecting with a mating electrical connector and transmitting signals between the electrical devices and external equipments. Conventional electrical connectors include an insulative housing and a number of electrical contacts attached to the insulative housing. The insulative housing has a number of passageways for receiving the electrical contacts. The electrical contacts each includes barbs thereon for engaging with the insulative housing and securing the electrical contacts.

The barbs are defined on a base plate of the electrical contact and located in a same plane with the base plate. When the electrical connector mates with the mating connector, an external force exerts on the electrical contacts. After repeatedly plug in and pull out, the external force will affect the engagement of the barbs and the insulative housing which results in the electrical contacts become loose in the passageways. Therefore, the electrical connection between the electrical devices and the electrical equipments will be affected.

Hence, it is desired to provide an electrical connector to overcome the deficiency of the conventional electrical contacts.

BRIEF SUMMARY OF THE INVENTION

Accordingly, an object of the present invention is to provide an electrical connector for securing the electrical contacts in the insulative housing reliably.

The present invention is directed to an electrical connector which includes an insulative housing having a front face and a rear face opposite to each other, and a plurality of side walls, and a plurality of electrical contacts. The side walls form a plurality of passageways extending between the front face and the rear face. The electrical contacts are received in the passageways and each includes a contacting portion, a tail portion and a main portion connecting the contacting portion with the tail portion. The main portion is configured to a U-shape and includes a horizontal plate and a pair of vertical plates. At least one vertical plate defines a fastening means projecting therefrom and engaging with the side wall of the insulative housing.

An electrical connector includes an insulative housing having a top wall, a bottom wall and a plurality of side walls, and a plurality of electrical contacts. The side walls form a plurality of passageways extending through the insulative housing. The electrical contacts are received in the passageways and each includes a contacting portion, a tail portion and a main portion connecting with the contacting portion and the tail portion. The main portion has a first fastening means engaging with the side wall and a second fastening means engaging with the top wall thereby securing the electrical contacts to the insulative housing.

An electrical connector includes an insulative housing having a top wall, a bottom wall and a plurality of side walls, and a plurality of electrical contacts. The side walls form a plurality of passageways extending through the insulative housing. The electrical contacts are received in the passageways and each includes a contacting portion, a tail portion and a main portion connecting with the contacting portion and the tail portion. The main portion has a first fastening means on a side thereof and a second fastening means at a top thereof, and both of the first and second fastening means engage with the insulative housing.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
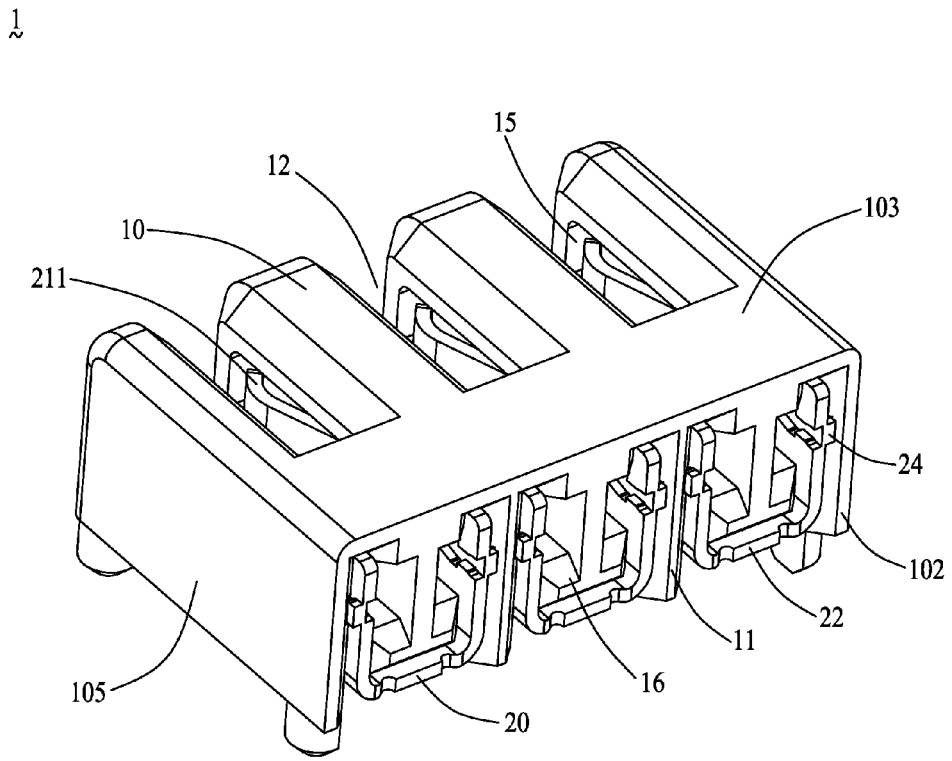
FIG. 1 is a perspective view of an electrical connector according to the present invention.

Reference will be made to the drawing figures to describe the present invention in detail, wherein depicted elements are not necessarily shown to scale and wherein like of similar elements are designated by same or similar reference numeral through the several views and same or similar terminology.

Figure 2:
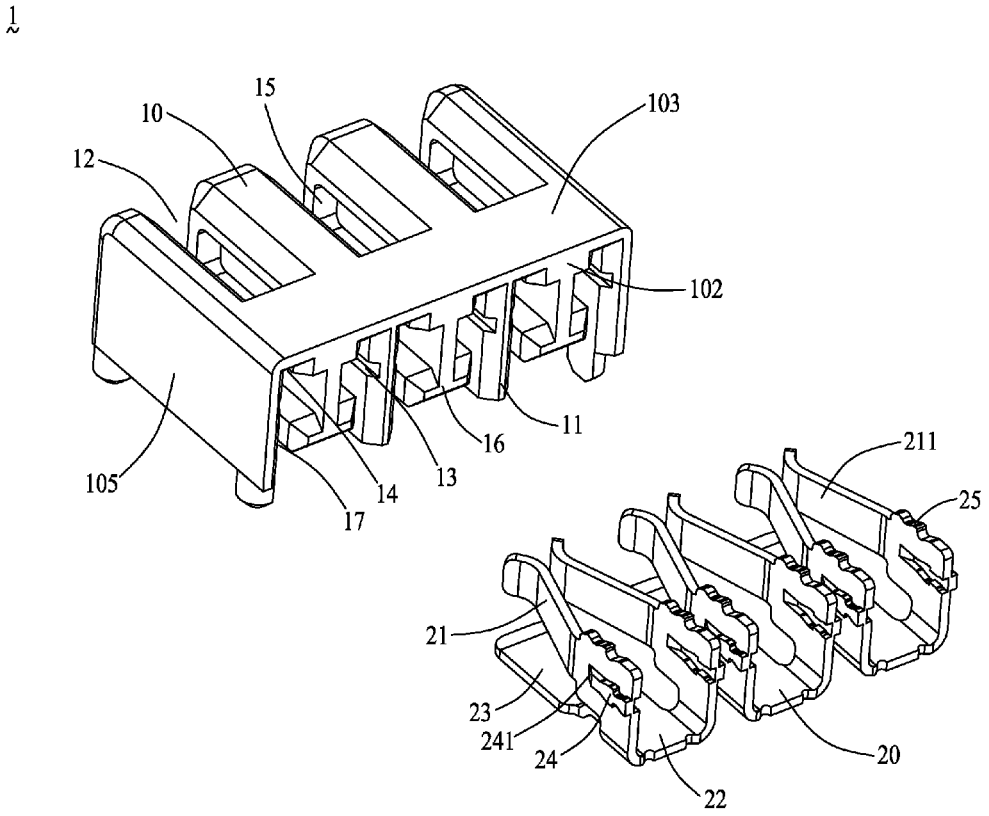
FIG. 2 is an exploded view of the electrical connector shown in FIG. 1.

Referring to FIGS. 1 and 2, the present invention is directed to an electrical connector 1 mounting to a PCB or motherboard (not shown) and having an insulative housing 10 and a plurality of electrical contacts 20 received in the insulative housing 10.

Figure 3:
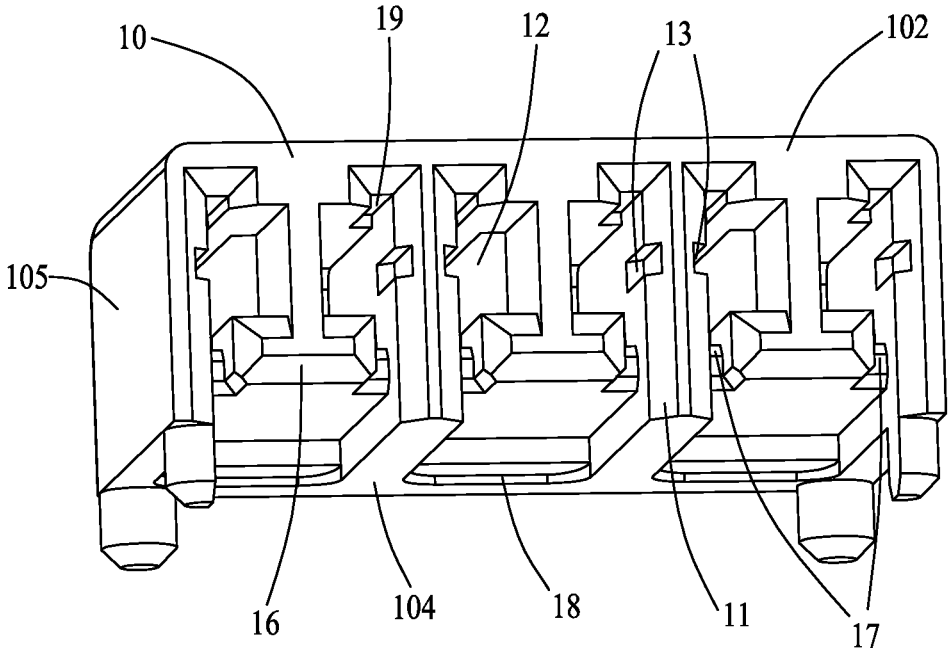
FIG. 3 is a perspective view of the insulative housing shown in FIG. 2.
Figure 4:
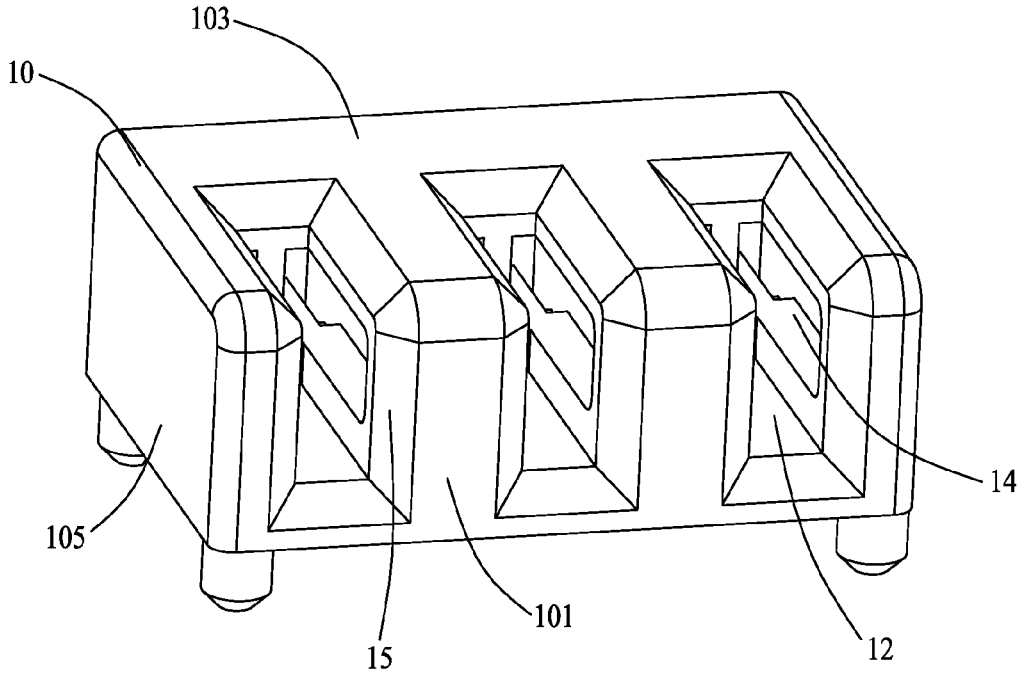
FIG. 4 is similar to FIG. 3 but shown from a different aspect.

Further referring to FIGS. 3 and 4, the insulative housing 10 has a front face 101 for mating with a mating electrical connector (not shown), a rear face 102 opposite to the front face 101, a top wall 103, a bottom wall 104 and a pair of side walls 105. The insulative housing 10 further has a plurality of inner side walls 11 which form a plurality of passageways 12 together with the pair of side walls 105. The passageways 12 extend through the front face 101 and the rear face 102 and expose at the top wall 103.

Please refer to FIG. 2, each passageway 12 includes a pair of side recesses 14 defined on the side walls 105 or the inner side walls 11, and a bottom recess 18 defined on the bottom wall 104. A lower plate 16 is disposed in the passageway 12 and separates the pair of side recesses 14 with the bottom recess 18. The pair of side recesses 14 each communicates with the bottom recess 18 at a rear end of the insulative housing 10 via a slit 17 defined on the lower plate 16. Each of the side recess 14 is shielded by a stop 15 at the front face 101. A pair of first slots 13 are defined on the side walls 105 or the inner side walls 11 and a pair of second slots 19 are defined on the top wall 103. The first and second slots 13, 19 are further recessed into the insulative housing 10 compared to the side recesses 14.

Figure 5:
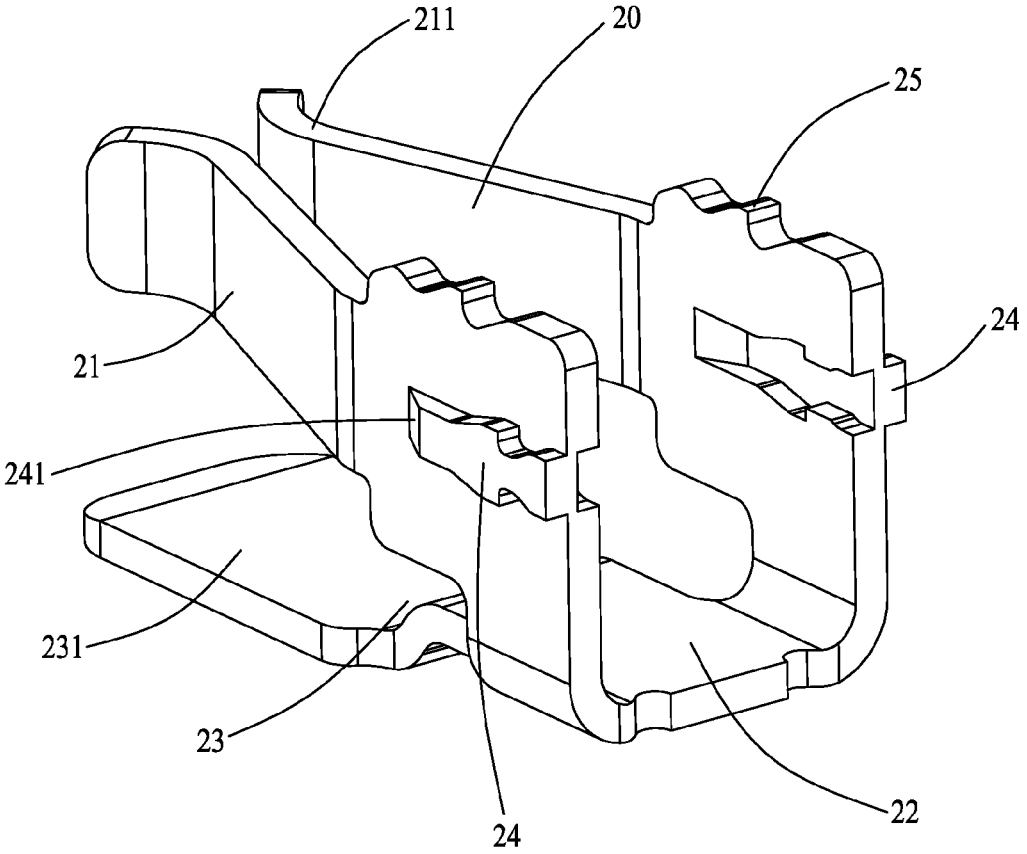
FIG. 5 is a perspective view of the electrical contact shown in FIG. 2.

Please referring to FIGS. 3-5, the electrical contacts 20 each has a contacting portion 21 for contacting with the mating electrical connector, a tail portion 23 electrically connected with the PCB, and a main portion 22 connecting the contacting portion 21 with the tail portion 23. The contacting portion 21 includes a pair of contacting arms 211 opposite to each other and received in the side recesses 14 respectively. The tail portion 23 and the contacting portion 21 both extend forwardly from the main portion 22. The tail portion 23 is located in the bottom recess 18 and has a solder pad 231 under the contacting arms 211.

The main portion 22 is configured to a U-shape which includes a horizontal plate connected with the tail portion 23 and a pair of vertical plates extending upwardly from the horizontal plate and connecting with the pair of contacting arms 211, respectively. The vertical plates each has a plurality of barbs 25 at a top thereof and are received in the second slot 19. Each vertical plate further includes a protrusion 24 at one side thereof and projecting outwardly. A front end of the protrusion 24 defines an oblique face 241 for guiding the electrical contact 20 inserted into the passageway 20.

The electrical contacts 20 are inserted into the passageway 12 from the rear face 102 of the insulative housing 10. The horizontal plate is received in the bottom recess 18 and the pair of vertical plates are received in the side recesses 14. The vertical plates and horizontal plate sandwich the lower plate 16 and the pair of contacting arms 211 are received in the side recesses 14 thereby supporting the electrical contact 20 in the passageway 12.

The pair of contacting arms 211 first project to each other from the vertical plates and then bend back so that a free end of the contacting arm 211 is located behind the stop 15. The stop 15 prevents the contacting arm 211 moving forwardly. The barbs 25 are received in the second slots 241 and engage with the top wall 103 thereby securing the electrical contact 20 to the insulative housing 10 not only in an up to down direction but also in a front to back direction. The protrusions 24 are received in the first slots 13 which provide another fastening means for the electrical contacts 20. The protrusion 24 can secure the electrical contacts 20 to the insulative housing 10 in two directions, one is the up to down direction, and the other is a left to right direction.

The electrical contacts 20 of the present invention has two fastening means to engage with the insulative housing, one is the barbs' interference with the top wall, and the other is the protrusion engaging with the side walls, which strengthen the engagement between the electrical contacts 20 and the insulative housing 10. Therefore, the two fastening means secure the electrical contact 20 in the insulative housing 10 firmly which ensures the electrical connection between the electrical connector and the mating connector.

Figure 6:
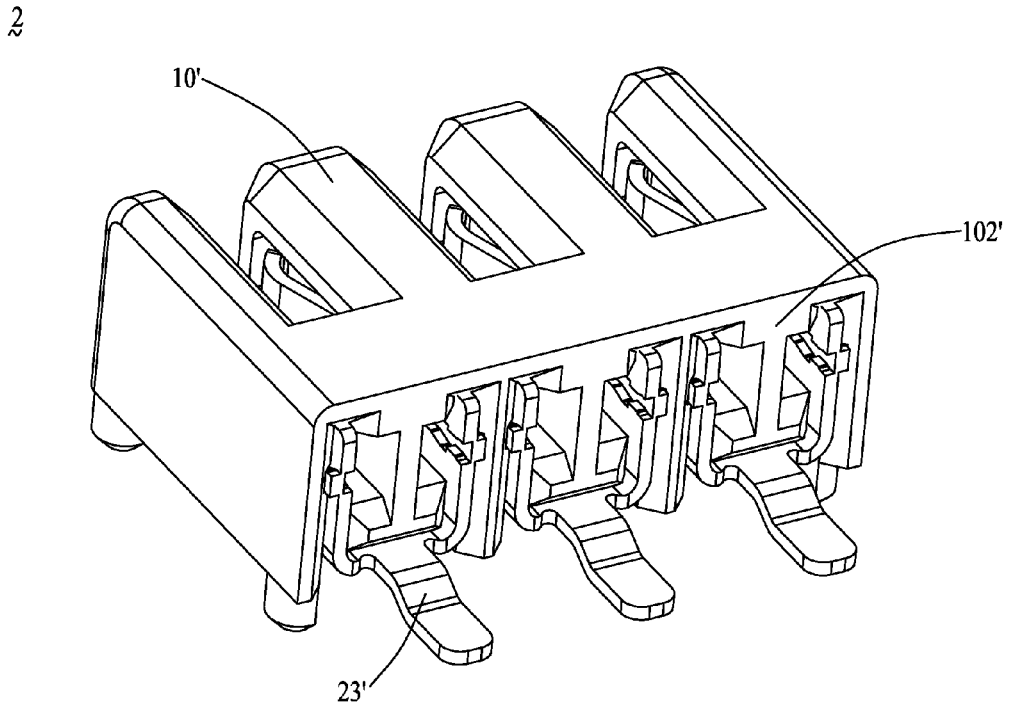
FIG. 6 is a perspective view of an electrical connector according to a second embodiment of the present invention.
Figure 7:
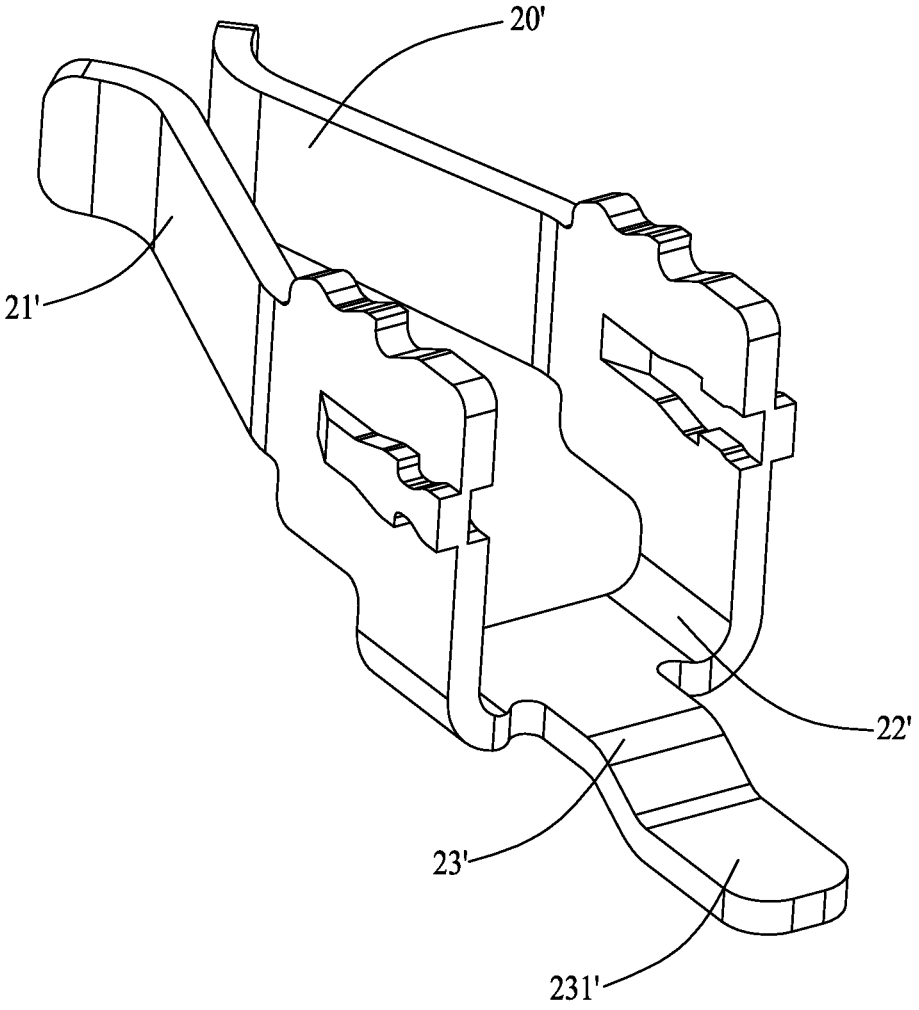
FIG. 7 is a perspective view of the electrical contact shown in FIG. 6.

Next referring to FIGS. 6 and 7, description will be made of an electrical connector 2 according to a second embodiment of the present invention. The electrical connector 2 is substantially similar to the electrical connector 1 except the tail portion 23' of the electrical contact 20'. The tail portion 23' and the contacting portion 21' extend in opposite directions from the main portion 22' thereby a solder pad 231' of the tail portion 23' projecting out of the rear face 102' of the insulative housing 10'.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a front face and a rear face opposite to each other, and a plurality of side walls, said side walls forming a plurality of passageways extending between the front face and the rear face; and a plurality of electrical contacts received in the passageways and each including a contacting portion, a tail portion and a main portion connecting the contacting portion with the tail portion;

wherein the main portion is configured to a U-shape and including a horizontal plate and a pair of vertical plates, and wherein at least one vertical plate defines a fastening means projecting therefrom and engaging with the side wall of the insulative housing, the fastening means extends outward from an outside wall of the vertical plate opposite to the horizontal plate.

2. The electrical connector according to claim 1, wherein the insulative housing defines a plurality of first slots on the side walls for receiving the fastening means.

3. The electrical connector according to claim 2, wherein a front end of the fastening means defines an oblique face for guiding the electrical contacts inserted into the passageway.

4. The electrical connector according to claim 1, wherein the insulative housing has a top wall and a bottom wall opposite to each other, and the vertical plate of the main portion defines a plurality of barbs engaging with the top wall of the insulative housing.

5. The electrical connector according to claim 1, wherein the insulative housing includes a lower plate disposed in the passageway and the main portion of the electrical contact clips the lower plate.

6. The electrical connector according to claim 1, wherein the contacting portion has a pair of contacting arms extending forwardly from the vertical plates respectively, and the tail portion extends forwardly from the horizontal plate, and wherein the insulative housing has a stop located in front of the contacting arm whereby preventing the contacting arm moving to the front face.

7. The electrical connector according to claim 1, wherein the contacting portion and the tail portion extend to opposite directions from the main portion.

8. An electrical connector comprising:

an insulative housing having a top wall, a bottom wall and a plurality of side walls, said side walls forming a plurality of passageways extending through the insulative housing; and a plurality of electrical contacts received in the passageways and each including a contacting portion, a tail portion and a main portion connecting with the contacting portion and the tail portion;

wherein the main portion has a first fastening means on a lateral side thereof for engaging with the side wall to limit a movement along an up-to-down direction and a second fastening means on an upper side for engaging with the top wall to limit a movement along a front-to-back direction, thereby secure the electrical contacts to the insulative housing.

9. The electrical connector according to claim 8, wherein the first fastening means is a protrusion projecting outwardly from the main portion and received in a first slot defined on the side wall of the insulative housing.

10. The electrical connector according to claim 9, wherein a front end of the first fastening means defines an oblique face for guiding the electrical contacts inserted into the passageway.

11. The electrical connector according to claim 8, wherein the second fastening means is a plurality of barbs disposed at a top of the body portion which are received in a second slot defined on the top wall.

12. The electrical connector according to claim 8, wherein the main portion includes a horizontal plate and a pair of vertical plates connecting with the horizontal plate, and wherein the first fastening means and the second fastening means are defined on each of the vertical plates.

13. The electrical connector according to claim 12, wherein the contacting portion has a pair of contacting arms extending from the vertical plates respectively.

14. The electrical connector according to claim 8, wherein the insulative housing includes a lower plate disposed in the passageway and the main portion of the electrical contact is supported by the lower plate.

15. An electrical connector comprising:

an insulative housing having a top wall, a bottom wall and a plurality of side walls, said side walls forming a plurality of passageways extending through the insulative housing; and a plurality of electrical contacts received in the passageways and each including a contacting portion, a tail portion and a main portion connecting with the contacting portion and the tail portion;

wherein the main portion has a first fastening means on a side thereof and a second fastening means at a top thereof, the first fastening means and a contacting point of the corresponding contacting portion are located on different sides of the corresponding contacting portion along a transverse direction, and both of the first and second fastening means engage with the insulative housing.

16. The electrical connector according to claim 15, wherein the first fastening means engages with the side wall and the insulative housing defines a first slot on the side wall to receive the first fastening means.

17. The electrical connector according to claim 15, wherein the second fastening means engages with the top wall and the insulative housing defines a second slot on the top wall to receive the second fastening means.

18. The electrical connector according to claim 16, wherein a front end of the first fastening means defines an oblique face for guiding the electrical contacts inserted into the passageway.

19. The electrical connector according to claim 15, wherein the main portion includes a horizontal plate and a pair of vertical plates connecting with the horizontal plate, and wherein the first fastening means and the second fastening means are defined on each of the vertical plates.

20. The electrical connector according to claim 19, wherein the insulative housing includes a lower plate disposed in the passageway and the main portion of the electrical contact is supported by the lower plate, and wherein the contacting portion has a pair of contacting arms extending from the vertical plates respectively, and the tail portion extends from the horizontal plate.

* * * * *